US006219888B1

(12) United States Patent
Lynch

(10) Patent No.: US 6,219,888 B1
(45) Date of Patent: Apr. 24, 2001

(54) ANCHOR DEVICE

(76) Inventor: James P. Lynch, 6807 Dudley Cir., Arvada, CO (US) 80004

( * ) Notice: Subject to any disclaimer, the term of this patent is extended or adjusted under 35 U.S.C. 154(b) by 0 days.

(21) Appl. No.: 09/348,098

(22) Filed: Jul. 6, 1999

Related U.S. Application Data

(63) Continuation-in-part of application No. 08/183,066, filed on Jan. 18, 1994, now Pat. No. 5,918,614.

(51) Int. Cl.[7] ..... F16G 11/00
(52) U.S. Cl. ..... 24/115 R; 24/129 R; 24/570
(58) Field of Search ..... 114/218, 221 R; 254/394, 402, 403, 389; 24/115 K, 129 R, 130, 115 R

(56) References Cited

U.S. PATENT DOCUMENTS 325,705 * 9/1885 Stephenson .
1,409,177 * 3/1922 Holman .
4,173,194 * 11/1979 McLaughlin ..... 114/218
5,359,962 * 11/1994 Loverich ..... 24/115 K

* cited by examiner

*Primary Examiner*—James R. Brittain
(74) *Attorney, Agent, or Firm*—Timothy J. Martin; Michael R. Henson; Mark H. Weygandt

(57) ABSTRACT

An anchor device is provided to engage a segment of a cord. The anchor device has a main body portion and a pair of opposed jaw portions that extend from the body in spaced-apart relationship to one another thereby to form a cavity with a rear wall. A retainer is disposed on the inner surface of each jaw portion with the retainers being separated by a longitudinal passageway. Each retainer has a surface spaced from the other jaw portion and rear portion located forwardly of the rear wall of the cavity. The rear portions form a transverse locking channel for releasably capturing a transverse extension of the cord. The retainers can be static structures or rotatable pulley elements.

17 Claims, 3 Drawing Sheets

ANCHOR DEVICE

This application is a continuation-in-part of U.S. patent application Ser. No. 08/183,066 filed Jan. 18, 1994 entitled Configurable Shade Structure Including Kit and Method Therefor, now U.S. Pat. No. 5,918,614.

FIELD OF THE INVENTION

The present invention is directed to an anchor device which is adapted to engage a cord along a cord segment. More particularly, the present invention relates to an anchor device for use to interconnect a cord with a support structure so that the cord is indirectly secured to the support structure.

BACKGROUND OF THE INVENTION

Tents and canopies have been used for decades to provide temporary and portable shelters for equipment and personnel. Generally, a tent or a canopy is a flexible covering suspended over an area to be protected and secured directly or indirectly to an earthen support surface usually by tethers. The tethers are each connected at one end to and along various locations at margin edges of the flexible covering and at an opposite end to stakes embedded into the earthen surface. The margin edges of the flexible covering extend peripherally around the flexible covering and often include a sewn seam or a welting. Metal eyelets are usually secured either directly into the seam or proximate to the welting. These eyelets act to reinforce the flexible covering at the locations of attachment thereby minimizing chances of tearing the flexible covering when the tether is pulled taunt to secure it over the protected area.

Sometimes an earthen support surface is not available when erecting a tent or canopy. In these cases, the tethers must be secured to some other type of support such as a post embedded in concrete or a fastener connected to a wall. Since such supports are often not movable, occasionally the tent or canopy must be raised and then re-positioned in order to align the metal eyelets at more optimum positions for tethering to the supports. If these supports are not appropriately position, the tent or canopy might appear distorted which distracts from any aesthetic appeal that modern tents and canopies provide.

Flexible cord is used in many types of applications in order to secure an article to a support. One of these many applications occurs in the sport of sailing. For example, sails are slidably retained on booms by loops of cord threaded through the eyelets in the seam of the sail and around the boom. Occasionally, severe windy conditions can cause the main body of the sail to tear away from its seam. Presently, the only option available to the sailor is to collapse the sail and stow it around the boom until repairs can be made.

Sails, tents and canopies are just a few samples of articles that are include flexible cords. Flexible cords can be either a cord itself or a flexible sheet of material having a welting. The welting could be standard whereby a margin edge of the flexible sheet of material is folded around a cord then sewn to itself. Sometimes the welting could be the margin edge of the flexible sheet of material rolled around itself numerous times then stitched along the centerline of the roll. In other instances, the welting could be numerous small folds of the margin edge about itself and sewn along its centerline. In all circumstances, these weltings are flexible and act similarly as a cord connected to the margin edge of the flexible sheet material.

There is a need in the industry for an anchor device to engage a cord along a cord segment. Specifically, there is a need for an anchor device to interconnect a flexible cord with a support structure. It would be advantageous if such anchor device could be connected to the welting or a cord and slide therealong so that the point of interconnection between the flexible cord structure and the support can be changed, if desired, without removing it from the cord. This feature would resolve the problem associated with erecting tents and canopies on certain surfaces where the tent or canopy must be oriented strategically relative to fixed supports. There is another need for an anchor device that could be used to interconnect a torn portion of a sail with a support so that the torn sail could continue to be employed during sailing without worry of further destruction. It would be advantageous of this anchor device would be simple and inexpensive to manufacture as well as easy to use. The present invention satisfies these needs and provides these advantages.

SUMMARY OF THE INVENTION

It is an object of the present invention to provide a new and useful anchor device adapted to engage a cord segment to interconnect a cord and a support structure so that the cord and the support structure can be indirectly secured to each other.

It is a further object of the present invention to provide an anchor device that can be used to retain a segment of a margin edge of tents, canopies, sails or other flexible sheets of materials having a welting for interconnecting the same to a support structure.

It is another object of the present invention to provide an anchor device for slidably retaining the cord segment so that the anchor device could move along the cord, when desired, without having to be disconnected therefrom.

It is still a further object of the present invention to provide an anchor device whereby, after being connected to the cord segment, the anchor device can slide along the cord in order to change the point of interconnection without having to removed the anchor device from the cord.

Yet another object of the present invention is to provide an anchor device which is simple in construction, easy to use and inexpensive to manufacture.

Accordingly, an anchor device of the present invention is hereinafter described. In it broadest form, the anchor device of the present invention which is adapted to engage a cord segment includes a body poriton and first and second opposed jaw portions. Each jaw portion has an inner surface with the inner surfaces being in a spaced-apart facing relation to one another to define a cavity therebetween. The cavity has a forwardly-disposed mouth opening and a pair of side openings disposed opposite one another and in communication with the mouth opening.

First and second retainers are disposed in the cavity and are laterally spaced from one another to define a passageway extending therebetween along a longitudinal axis. The first retainer is secured to the first jaw portion and has a first upper slide surface spaced from the inner surface of the second jaw portion; the second retainer is secured to the second jaw portion and has a second upper slide surface spaced from the inner surface of the first jaw portion. Each of the first and second retainers forms a channel portion opposite the mouth opening of the cavity. The channel portions are transversely aligned to the passageway to form a locking channel.

Thus, the body member may be advanced onto a length of the cord segment with the first and second jaw portions positioned on opposite sides thereof. The length of the cord segment accordingly enters the mouth opening and slides along the side openings and across the retainers and into the locking channel. When the cord segment is received in the locking channel, opposite end portions of the cord segment extend from respective ones of the side openings with the cord segment being slidably retained within the channel portions. Each of the first and second upper surfaces of respective ones of the first and second retainers inclines upwardly from respective inner surfaces of the first and second jaw portions. The inclination of each first and second upper surfaces commences proximate to the mouth opening and extends toward the channel portions.

One embodiment of the anchor device of the present invention incorporates a block member for each of the first and second retainers. It is preferred that these first and second retainers are formed as a unitary construction with respective ones of the first and second jaw portions. Each block member is configured with a first edge extending along and parallel to the channel portion, a second edge connected to the first edge in a perpendicular relationship and extending along and parallel to the passageway and a third edge. The third edge is arcuate and is connected to and between the first and second edges. For this embodiment, the inclination commences proximate to the mouth opening at an intersection of the second and third edges so that respective ones of first and second retainers terminate in a rear wall that has a surface partially defining a respective one of the channel portions. The rear wall surface is preferably concave in configuration and sized and adapted to receive the cord segment. It is also preferred that the first and second upper surfaces of respective ones of the first and second retainers inclines away from respective inner surfaces of the first and second jaw portions commencing along the second edge toward the third edge. It is further preferred that each of the first and second upper surfaces of respective ones of the first and second retainers is curved.

Another embodiment of the anchor device of the present invention includes first and second retainers that are each a roller assembly. The roller assembly includes a disk-shaped pulley element rotatably mounted onto a shaft connected to a respective one of the inner surfaces. Each of the pulley elements has an outer concave peripheral edge which is sized and adapted to receive the length of the cord segment.

Preferably, the body member includes an arm portion which is connected to at least one of the first and second jaw portions. The arm portion extends longitudinally and oppositely from that one of the first and second jaw portions. The arm portion has a hole extending therethrough. This embodiment of the anchor device has the arm portion and the one of first and second jaw portions as a unitary construction. Each of the first and second jaw portions has a jaw width and the arm portion has an arm width that is less than the jaw width.

These and other objects of the present invention will become more readily appreciated and understood from consideration of the following detailed description of the exemplary embodiments of the present invention when taken in conjunction with the accompanying drawings, in which:

DETAILED DESCRIPTION OF THE EXEMPLARY EMBODIMENTS

An anchor device of the present invention which is adapted to engage a cord segment is hereinafter described. One of ordinary skill in the art would appreciate numerous types of cords and cord segments anticipated for use with the present invention. For example, one type of cord or cord segment that could engage the anchor device of the present invention other than a conventional cord could be a welting that is sewn into an edge of a product fabricated from flexible sheet material such as a canopy. Another example of a cord or cord segment is a rolled edge of a flexible sheet material. A cord or cord segment could be impromptu fabricated by enveloping a cord around flexible sheet material which could be useful for temporarily securing torn sails. Thus, when describing the exemplary embodiments of the anchor device of the present invention, the terms "cord" or "cord segment" are employed in a generic sense since a skill artisan would construe these term to include other types of cords and cord segments which could be utilized with the present invention without departing from the spirit and inventive concepts disclosed herein.

Figure 1:
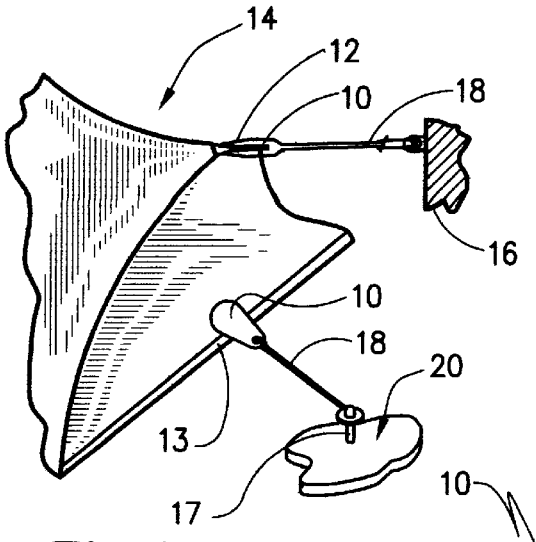
FIG. 1 is a perspective view showing two identical anchor devices of the present invention engaged with cord segments of a canopy and interconnecting a cord segment of the canopy with a support structure so that the cord segment is secured to the support structure.

A first exemplary embodiment of an anchor device 10 of the present invention is generally introduced in FIGS. 1–8. In FIG. 1, two anchor devices 10 of the present invention are shown engaging respective ones of cord segments 12,13 of a canopy 14. One such anchor device interconnects cord segment 12 of canopy 14 to a support structure 16 while another interconnects cord segment 13 to a stake 17 set in ground 20, each by way of a tether 18.

As best shown in FIGS. 2–7, a representative anchor device 10 of the present invention includes a body portion 22. First and second opposed jaw portions 28 and 30 extending forwardly of body portion 22. Each jaw portion 28 and 30 has a front edge 31, an inner surface 32 and a pair of side edges 33. Inner surfaces 32 face one another and are spaced-apart from one another a selected distance "d", preferably about one-half inch (1.27 cm). To this end, also, jaw portions 28 and 30 are in parallel facing relation to one another so as to define a cavity 34 therebetween. Cavity 34 has a forwardly-disposed mouth opening 36 and a pair of side openings, such as side opening 38 (FIG. 6) which are laterally disposed opposite one another and in communication with mouth opening 36 and a back wall 39. Preferably, anchor device 10 is constructed by a pair of substantially identical anchor halves 50 and 52 (FIG. 8) which are fastened together.

Jaw portions 28 and 30 include retaining structures to secure the cord segment. For example, first jaw portion 28 includes a first retainer 24 while second jaw portion 30 includes a second retainer 26. First and second retainers 24 and 26 are disposed in cavity 34 and are oriented laterally from one another and are laterally spaced to define a passageway 40 extending longitudinally therebetween along an axis "A" and centrally located in the cavity 34.

The rear portions of each of first and second retainers 24 and 26 are located forwardly of wall 39 to form a transverse locking channel 46 opposite mouth opening 36 of cavity 34. Thus, locking channel portion 47 is located between the rear portion of retainer 24 and rear wall 39 and locking channel portion 49 is located between the rear portion of retainer 26 and rear wall 39. Locking channel 46 is transversely aligned relative to passageway 40. First retainer 24 is secured to first jaw portion 28 and has a base 41 and a first slide surface 42. Second retainer 26 is secured to second jaw portion 30 and has a base 43 and a second slide surface 44. Slide surfaces 42 and 44 are each spaced a selected distance "x" from its respective inner surface 32, with this distance "x" being larger than one-half of the distance between inner surfaces 32 when anchor halves 50 and 52 are assembled. Accordingly, first slide surface 42 is slightly spaced from inner surface 32 of second jaw portion 30, and second slide surface 44 is slightly spaced from inner surface 32 of first jaw portion 28.

It is preferred that anchor device 10 is fabricated with a first anchor half 50 and a second anchor half 52, as shown in FIGS. 2–6, which preferably are sized and configured identically. First anchor half 50 includes first jaw portion 28 and a first arm portion 54 extending along longitudinal axis "A" which is connected to first jaw portion 28 that also extends along longitudinal axis "A" but in a direction opposite of first jaw portion 28. Second anchor half 52 includes second jaw portion 30 and a second arm portion 56 extending along longitudinal axis "A" which is connected to second jaw portion 30 that also extends along longitudinal axis "A" but in a direction opposite of second jaw portion 30. Preferably, first jaw portion 28 and first arm portion 54 are integrally formed as a one-piece construction; likewise, second jaw portion 30 and second arm portion 56 are integrally connected as a one-piece construction. For example, each of anchor halves 50 and 52 can be injection molded of a convenient plastic material.

Each of first anchor half 50 and second anchor half 52 is generally spatulate in shape such that inner surfaces 32 are formed with a slight concavity. First and second jaw portions 28 and 30 each has a jaw width '$w_j$" while each of first and second arm portions 54 and 56 has an arm width "$w_a$" best shown in FIG. 3. Jaw width "$w_j$" is greater than arm width "$w_a$". Although not by way of limitation, respective first and second jaw portions 28 and 30 have chamfered corners 72 at a distal end thereof, and respective first and second arm portions 54 and 56 also have chamfered corners 74 at a distal end thereof. Also, each of first and second arm portions 54,56 has a hole 60 extending therethrough which is located proximate the distal end thereof.

First and second arm portions 54 and 56 are sized and adapted to abut one another and be connected together to form a single arm 58. Such connection is achieved by a conventional adhesive disposed between abutting portions, by ultrasonic welding or by any other conventional methods commonly known in the industry. With first and second arm portions 54 and 56 being connected together to form single arm 58, first and second anchor halves 50 and 52 form body member 22. Furthermore, holes 60 in each first and second arm portions register with each other to form a single hole through anchor device 10 when first and second arm portions 54 and 56 are connected together.

Figure 8:
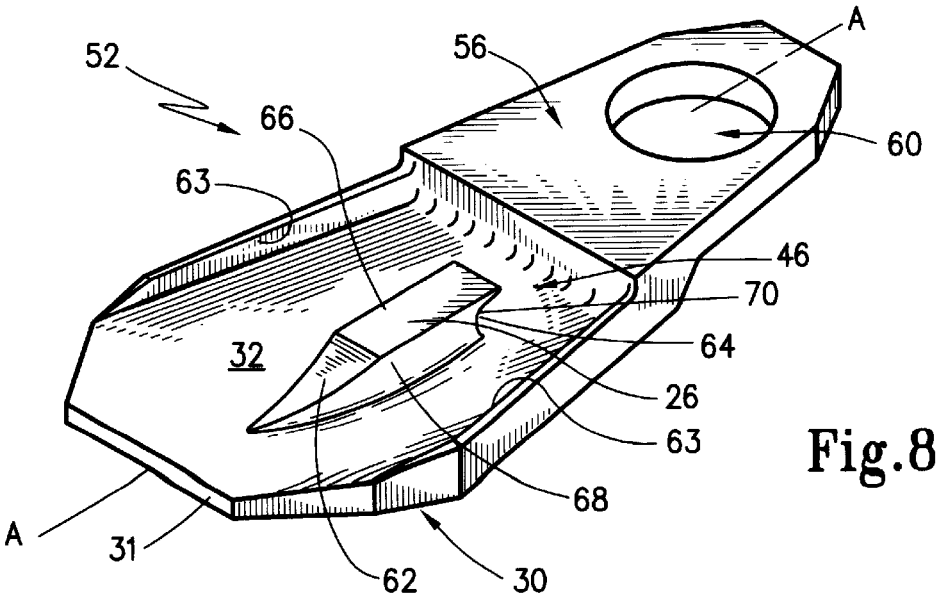
FIG. 8 is a perspective view of an anchor half of the anchor device according to the first exemplary embodiment of the present invention.
Figure 7:
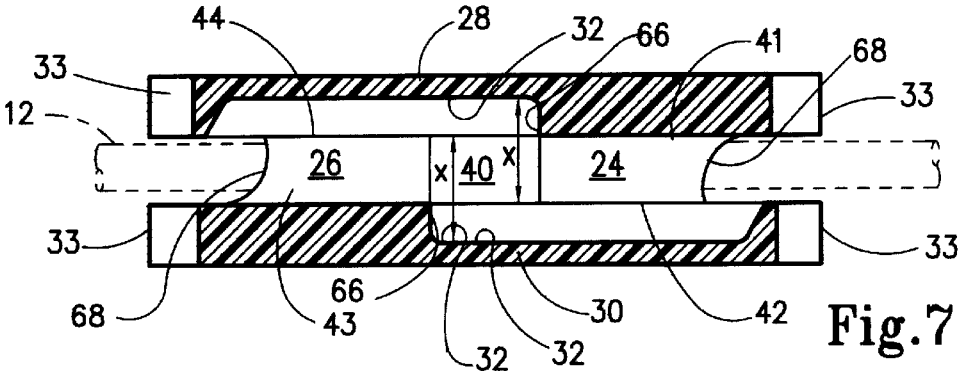
FIG. 7 is an end view in cross-section of the anchor device of the present invention taken along line 7—7 of FIG. 3.
Figure 9:
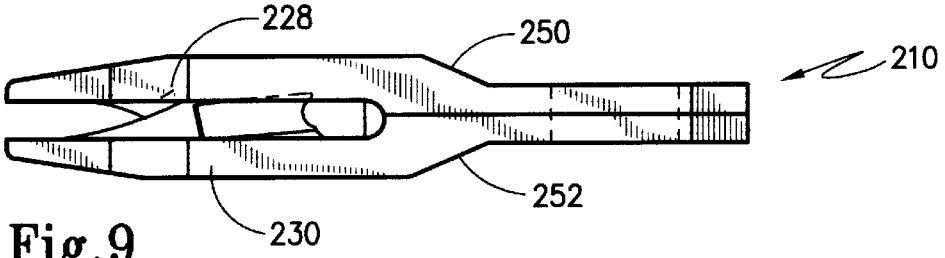
FIG. 9 is a side view in elevation of an anchor device according to a second exemplary embodiment of the present invention.

Attention is now again directed to first and second retainers 24 and 26. As best shown in FIGS. 2–8, first retainer 24 is secured to first jaw portion 28 and has a base 41 and a first slide surface 42. Second retainer 26 is secured to second jaw portion 30 and has a base 43 and a second slide surface 44. For the first exemplary embodiment of anchor device 10, each of first and second retainers 24 and 26 is a block member 62 (FIG. 8). As best shown in FIG. 8, a block member 62 is disposed on inner surface 32 of representative second jaw portion 30 on one side of longitudinal axis ""A" and a pair of ridges 63 extends along each side edge of second jaw portion 30 on an opposite side of longitudinal axis "A". Block member 62 is configured with a rear portion 64, a first side portion 66 and a second side portion 68. Rear portion 64 extends along and parallel to locking channel 46. First side portion 66 is connected to rear portion 64 in a perpendicular relationship and extends along and parallel to passageway 40. Although not by way of limitation, second side portion 68 is arcuate and is connected to and between rear portion 64 and first side portion 66.

Slide surfaces 42 and 44 incline in two different directions simultaneously. First, each of first and second slide surfaces 42 and 44 of respective ones of first and second retainers 24 and 26 inclines upwardly from respective inner surfaces 32 of first and second jaw portions 28 and 30 in a first direction that commences proximate to mouth opening 36 at an intersection of first and second side portions 66 and 68 and extends toward locking channel 46 and second side portion 68. There, the inclination terminates at rear portion 64 which has a rear surface 70 that is concave in configuration to partially defines locking channel 46. For the first exemplary embodiment of anchor device 10, the rear wall surface is sized and adapted to receive cord segment 12. Second, each of first and second slide surfaces 42 and 44 of respective ones of first and second retainers 24 and 26 inclines away from respective inner surfaces 32 of first and second jaw portions 28 and 30 that commences along first side portion 66 and toward second side portion 68. Preferably, each of first and second slide surfaces 42 and 44 of respective ones of first and second retainers 24 and 26 is curved. For the first embodiment of anchor device 10 of the present invention, first and second retainers 24 and 26 are formed as a unitary construction with respective ones of first and second jaw portions 28 and 30.

Figure 2:
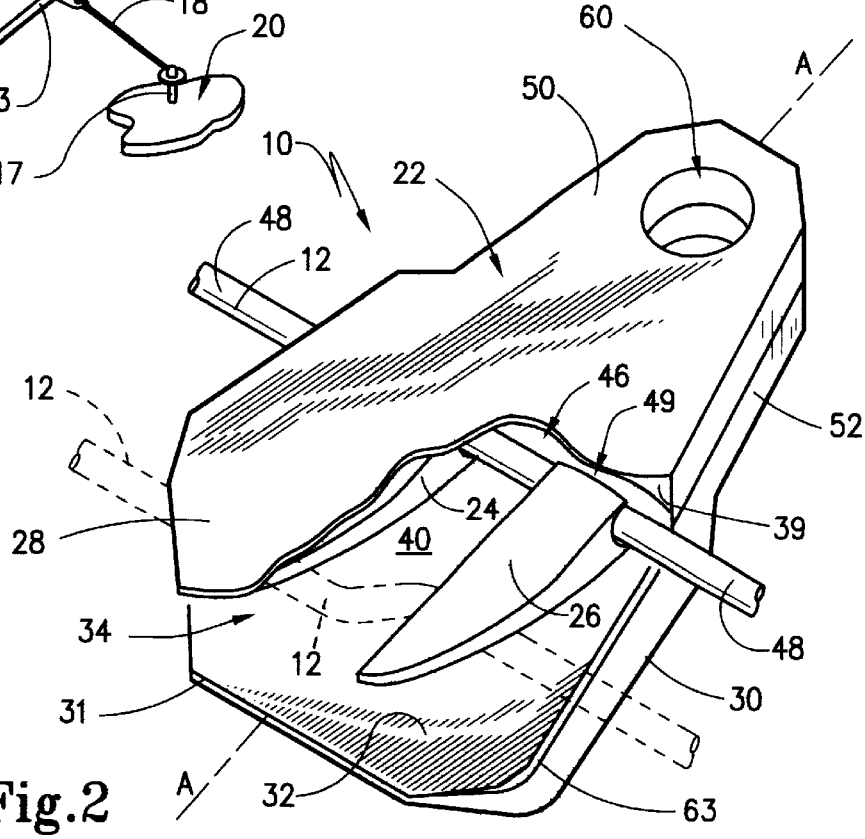
FIG. 2 is an enlarged perspective view partially broken away of a first exemplary embodiment of the anchor device of the present invention receiving and capturing a cord segment therein with the insertion of the cord segment into the anchor device being shown in phantom.
Figure 3:
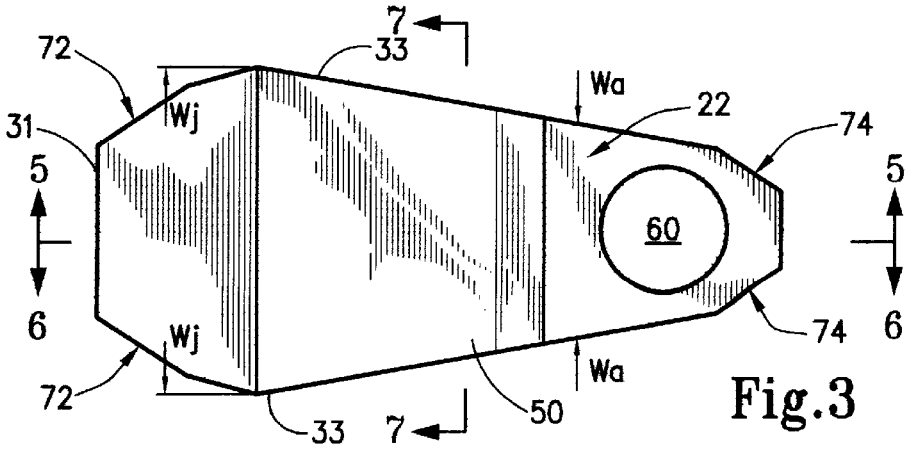
FIG. 3 is a top plan view of the anchor device of the anchor device according to the first exemplary embodiment of the present invention.
Figure 5:
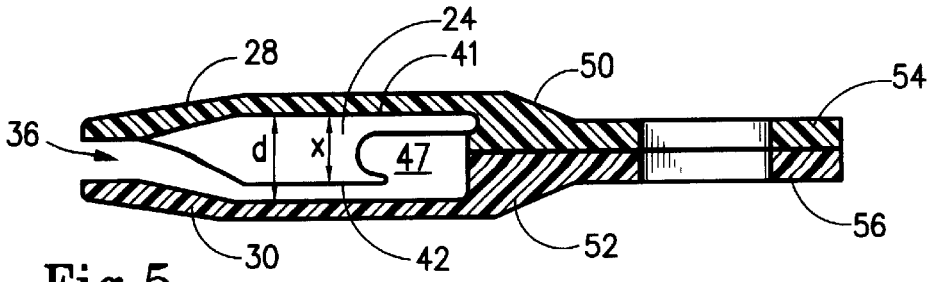
FIG. 5 is a side view in cross-section of the anchor device of the present invention taken along line 5—5 of FIG. 3.
Figure 6:
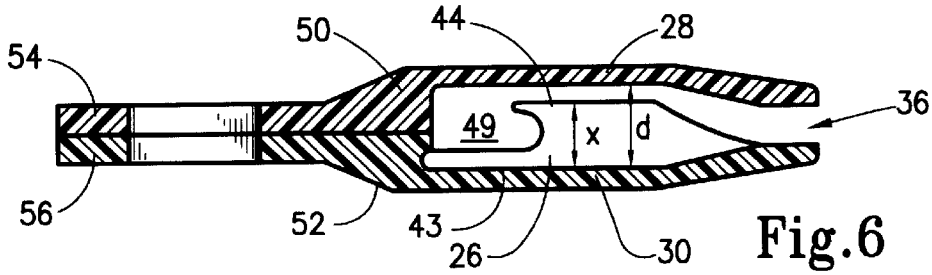
FIG. 6 is a side view in cross-section of the anchor device of the present invention taken along line 6—6 of FIG. 3.
Figure 4:
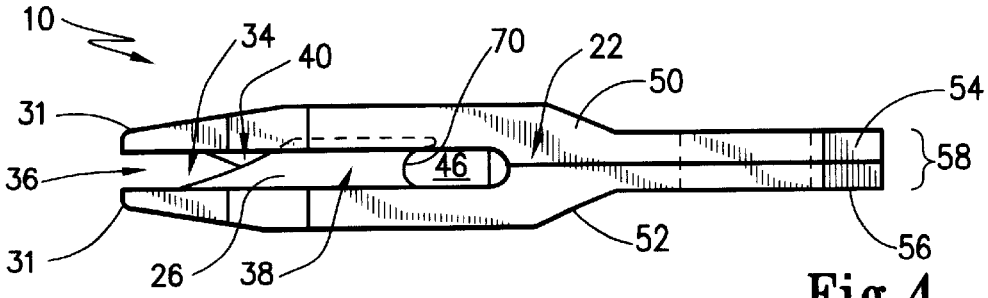
FIG. 4 is a side view in elevation of the anchor device shown in FIG. 3.

Now, with reference to FIG. 2, the use of anchor device 10 may be more fully appreciated. Here, anchor device 10 is advanced onto a length of cord segment 12 with first and second jaw portions 28 and 30 positioned on opposite sides thereof. The length of the cord segment 12 enters mouth opening 36 and slides along side openings 38 and across first and second slide surfaces 42 and 44 of retainers 24 and 26 (as is drawn in phantom in position A) and into locking channel 46 wherein opposite end portions 48 of cord segment 12 extend from respective ones of side openings 38 while cord segment 12 is slidably retained within locking channel 46.

A second exemplary embodiment of an anchor device 210 of the present invention is generally introduced in FIGS.

9–11. Anchor device 210 employs similarly constructed anchor halves 250 and 252 which are joined together as described with respect to anchor halves 50 and 52. Accordingly, opposed jaw portions 228 and 230 act to capture a cord segment. Since the anchors halves are the same, only a description of anchor half 252 is provided to avoid redundancy. In this embodiment, though, it should be understood that anchor device 210 employs a pair of retainers that each include a roller assembly to facilitate sliding movement of anchor device 210 laterally along a cord received therein.

Figure 10:
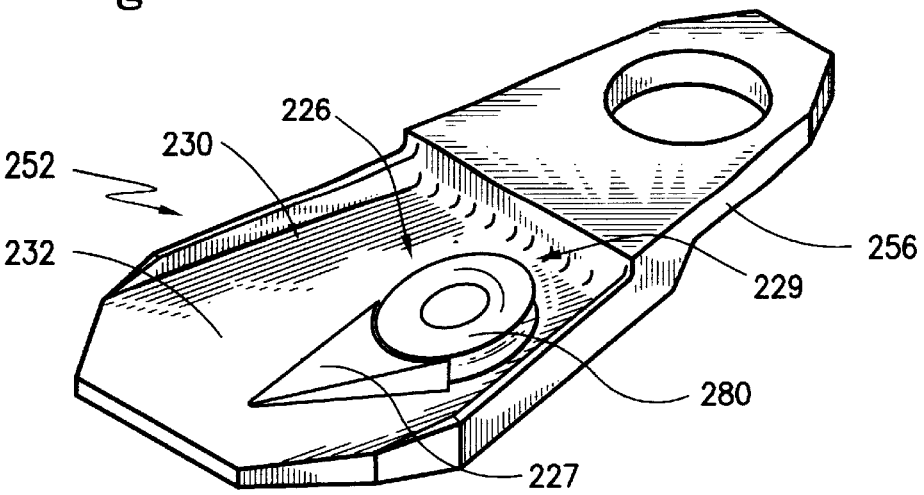
FIG. 10 is a perspective viewof an anchor half used to form the anchor device according to the second exemplary embodiment of the present invention.
Figure 11:
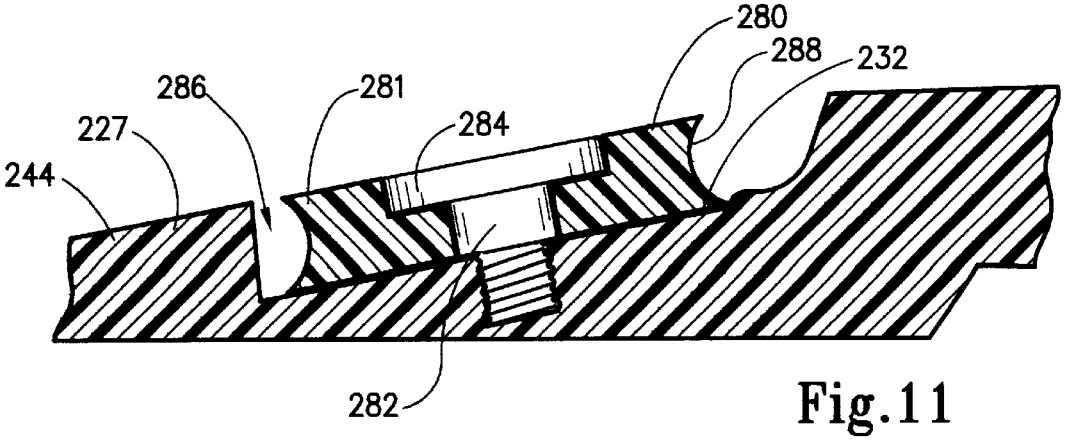
FIG. 11 is a partial side view in cross-section of the anchor half shown in FIG. 10.

With reference then to FIGS. 10 and 11, anchor half 252 includes a jaw portion 230 that extends forwardly of arm portion 256. A retainer 226 is formed on inner surface 232 and includes a forward ramp portion 227 and a roller assembly 229. Roller assembly 229 a disk-like, cylindrically-shaped roller element 280 which is rotatably journaled on a shaft 282 connected to a respective one of inner surfaces 232 of jaw portion 230. Shaft 282 has a cap 284 which is in a plane that is coextensive with both the plane of the upper slide surface 244 of ramp portion 227 and the upper flat side 281 of roller element 280. Cap 284 also rotatably retains roller element 280 into a recess 286 and shaft 282 may be fastened to jaw portion 230 in any convenient manner. Roller element 280 has an outer concave peripheral edge 288 which is sized and adapted to receive cord segment 12.

The anchor device of the present invention engages a cord segment to interconnects a cord and a support structure so that the cord and the support structure are indirectly secured to each other. The anchor device of the present invention can slide along the cord, when desired, so that the point of interconnection between the flexible cord structure and the support structure can be changed without removing the anchor device from the cord. Tents and canopies can now be erected on certain surfaces without having to orient the tent or canopy strategically to fixed supports. Also, the anchor device of the present invention could be used to interconnect a torn portion of a sail with a support by rolling the torn edge into a welting. The anchor device of the present invention can now be used to interconnect the welting to a support so that the torn sail could continue to be employed during sailing without worry of further destruction. The anchor device is simple in design, inexpensive to manufacture and easy to use. Furthermore, the hole formed in the arm renders the anchor device of the present invention quite versatile. The hole can be used to tie a rope to the anchor device and then tethered to the support structure such as a stake or a tree. The hole is also useful to receive the stake directly thereby eliminating the use of rope where possible.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. An anchor device adapted to engage a cord segment, comprising:

(a) a body portion;

(b) first and second jaw portions extending forwardly of said body portion in a forward direction and including a front edge and a pair of side edges, said first and second jaw portions being in spaced-apart relationship to one another thereby to define a cavity between respective inner surfaces thereof with the cavity having a rear wall, a forwardly disposed mouth and a pair of side openings extending between the mouth and the rear wall, each of said jaw portions including a retainer disposed on its inner surface with said retainer on each one of said jaw portions having a base secured to its respective jaw portion and a slide surface that is opposite the base that terminates in spaced relation to the inner surface of another of said jaw portions, said first and second retainers of the respective jaw positions being oriented laterally with respect to one another thereby to define a longitudinal passageway extending therebetween, said first and second retainers each having rear portions located forwardly of said rear wall which together form a transverse locking channel extending along said rear wall, said locking channel being sized to releasably capture a transverse extension of said cord segment therein.

2. An anchor device according to claim 1 wherein each of said first and second sliding surfaces is rearwardly inclined relative to the inner surface of its respective jaw portion.

3. An anchor device according to claim 2 wherein each of said first and second retainers is formed as an integral one-piece extension of its respective jaw portion.

4. An anchor device according to claim 1 wherein the rear portion of each said retainer is concave.

5. An anchor device according to claim 1 wherein the inner surfaces of said first and second jaw portions are spaced apart a first distance and wherein each of said retainers has a height measured between its slide surface and the inner surface of its respective jaw portion, the height of each retainer being greater than one-half of the first distance.

6. An anchor device according to claim 1 wherein each of the inner surfaces is formed with a concavity.

7. An anchor device according to claim 1 wherein each of said jaw portions includes a ridge formed along each side edge thereof.

8. An anchor device according to claim 1 wherein each of said first and second retainers includes a disk-shaped pulley element journaled for rotation about a rotation axis, said pulley element having a pair of parallel sides and a circular rim, the circular rim defining said rear portion of a respective retainer and one of said parallel sides defining a portion of the respective slide surface.

9. An anchor device according to claim 8 wherein the rotation axis of each said pulley element is oblique with respect to the inner surface of its respective jaw portion.

10. An anchor device according to claim 1 wherein said body portion includes an arm portion connected to at least one of said first and second jaw portions and extending rearwardly therefrom.

11. An anchor device adapted for use to interconnect a cord segment with a support structure so that the cord is indirectly secured to the support structure, comprising:

(a) a first anchor half including a first arm portion extending rearwardly along a first longitudinal axis and a first jaw portion connected to said first arm portion and extending forwardly along the first longitudinal axis opposite said first jaw portion;

(b) a second anchor half including a second arm portion extending rearwardly along a second longitudinal axis and a second jaw portion connected to said second arm portion and extending forwardly along the second longitudinal axis opposite said second jaw portion, each of said anchor halves having a substantially common construction, said first and second arm portions connected together to form a common body member with said first and second jaw portions being in spaced-apart, opposed relation, each jaw portion having an inner surface with said inner surfaces being in a facing relation to one another to define a cavity therebetween, said cavity having a rear wall, a forwardly-disposed mouth and a pair of side openings extending between the mouth and the rear wall; and (c) a first retainer disposed on the inner surface of said first jaw portion and a second retainer disposed on the inner surface of said second jaw portion, each of said first and second retainers having a base secured to the inner surface of its respective jaw portion and a slide surface that is opposite said base with the slide surface of said first retainer terminating in spaced relation to the inner surface of said second jaw portion and with the slide surface of said second retainer terminating in spaced relation to the inner surface of said first jaw portion, said first and second retainers being oriented laterally with respect to one another when said first and second anchor halves are connected thereby to define a longitudinal passageway extending therebetween, said first and second retainers each having rear portions located forwardly of said rear wall which together form a transverse locking channel extending along said rear wall, said locking channel being sized to releasably capture a transverse extension of said cord segment therein.

12. An anchor device according to claim 11 wherein said first and second retainers are of unitary construction with said first and second jaw portions, respectively.

13. An anchor device according to claim 11 wherein said first and second anchor halves are connected together by an adhesive.

14. An anchor device according to claim 11 wherein said first and second retainers each is formed by a roller assembly that includes a disc-shaped pulley element rotatably mounted onto a shaft connected to a respective one of said first and second jaw portions.

15. An anchor device according to claim 11 wherein each of said first and second sliding surfaces is rearwardly inclined relative to the inner surface of its respective jaw portion.

16. An anchor device according to claim 11 wherein the rear portion of each said of said first and second retainers is concave.

17. An anchor device according to claim 11 wherein the inner surfaces of said first and second jaw portions are spaced apart a first distance and wherein said first and second retainers each has a height measured between its slide surface and the inner surface of the first and second jaw portions, respectively, the height of each retainer being greater than one-half of the first distance.

* * * * *